US008656822B1

(12) United States Patent
Saucedo

(10) Patent No.: US 8,656,822 B1
(45) Date of Patent: Feb. 25, 2014

(54) BALLISTIC FLOOR BLANKET

(75) Inventor: Kent D. Saucedo, Mesa, AZ (US)

(73) Assignee: ARMORWORKS Enterprises, LLC, Chandler, AZ (US)

( * ) Notice: Subject to any disclaimer, the term of this patent is extended or adjusted under 35 U.S.C. 154(b) by 274 days.

(21) Appl. No.: 12/799,197

(22) Filed: Apr. 20, 2010

Related U.S. Application Data

(60) Provisional application No. 61/214,112, filed on Apr. 20, 2009.

(51) Int. Cl.
*F41H 5/04* (2006.01)

(52) U.S. Cl.
USPC ..... 89/36.02; 89/36.08; 89/36.05; 89/36.01; 89/929; 89/937; 89/939

(58) Field of Classification Search
USPC ..... 89/36, 36.04, 36.11, 36.01, 36.02, 89/36.07, 36.08, 36.05; 54/65, 66, 68, 54/79.2
See application file for complete search history.

(56) References Cited

U.S. PATENT DOCUMENTS

| | | | | | |
|---|---|---|---|---|---|
| 742,701 | A | * | 10/1903 | Maussner | 54/65 |
| 3,801,416 | A | * | 4/1974 | Gulbierz | 109/49.5 |
| 3,924,038 | A | * | 12/1975 | McArdle et al. | 428/49 |
| 5,377,577 | A | * | 1/1995 | Bounkong et al. | 89/36.05 |
| 5,448,938 | A | * | 9/1995 | Fernandez et al. | 89/36.02 |
| 5,517,894 | A | * | 5/1996 | Bohne et al. | 89/36.02 |
| 5,679,918 | A | * | 10/1997 | Korpi et al. | 89/36.08 |
| 5,789,327 | A | * | 8/1998 | Rousseau | 442/135 |
| 6,161,462 | A | * | 12/2000 | Michaelson | 89/36.01 |
| 6,508,193 | B2 | * | 1/2003 | De Quatrebarbes | 114/345 |
| 7,389,718 | B1 | * | 6/2008 | Carter et al. | 89/36.02 |

* cited by examiner

*Primary Examiner* — Michael Carone
*Assistant Examiner* — John D. Cooper
(74) *Attorney, Agent, or Firm* — Schwartz Law Firm, P.C.

(57) ABSTRACT

A ballistic floor blanket is adapted for use in a military vehicle. The floor blanket includes top and bottom assembly covers, and an interior ballistic fabric composite intermediate the top and bottom assembly covers. The fabric composite incorporates a plurality of overlying structural ballistic layers. The ballistic layers include high-performance fibers having a tensile strength greater than about 2000 MPa and an elastic modulus greater than about 60 GPa. A retention assembly having a plurality of peripherally spaced floor anchors is adapted for attaching the floor blanket to the military vehicle.

20 Claims, 5 Drawing Sheets

BALLISTIC FLOOR BLANKET

TECHNICAL FIELD AND BACKGROUND

The present disclosure relates broadly to a ballistic floor blanket for military vehicles, including light, medium and heavy tanks; utility vehicles; anti-aircraft and anti-tank vehicles; towed artillery; and the like. In one exemplary application, the present ballistic blanket is applicable for use in a gun turret, sub-turret (or cupola), or finial. The exemplary blanket may also be used in the hull or other areas of the military vehicle to protect passengers from injury in the event of an under-vehicle explosion.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a ballistic floor blanket for use in a military vehicle. The floor blanket comprises top and bottom assembly covers, and an interior ballistic fabric composite intermediate the top and bottom assembly covers. The fabric composite comprises a plurality of overlying structural ballistic layers. The exemplary ballistic layers comprise high-performance fibers having a tensile strength greater than about 2000 MPa and an elastic modulus greater than about 60 GPa. A retention assembly includes a plurality of peripherally spaced floor anchors adapted for attaching the floor blanket to the military vehicle.

The term "overlying" is used broadly herein to mean the disposition of multiple directly adjacent or spaced-apart layers residing in complete or partial overlapping (or superimposed) registration.

According to another exemplary embodiment, the high performance fibers are selected from a group consisting of S-glass, aramid, high molecular weight polyethylene (HMWPE), polybenzobisoxazole (PBO), and polypyridobisimidazole (PIPD). Other exemplary high performance fibers may have a tensile strength of at least 7 grams per denier.

According to another exemplary embodiment, the interior fabric composite includes an adhesive film residing between adjacent ones of the ballistic layers.

According to another exemplary embodiment, the top assembly cover includes a textured slip-resistant material.

According to another exemplary embodiment, the slip-resistant material comprises neoprene rubber.

According to another exemplary embodiment, the bottom assembly cover comprises a ripstop fabric.

According to another exemplary embodiment, the ripstop fabric is a urethane coated polyester ripstop.

According to another exemplary embodiment, the interior fabric composite further includes top and bottom composite covers.

According to another exemplary embodiment, the top and bottom composite covers comprise a flame resistant synthetic rubber.

According to another exemplary embodiment, the synthetic rubber is a chlorosulfonated polyethylene synthetic rubber (CSM).

According to another exemplary embodiment, the interior fabric composite includes at least three overlying ballistic layers.

According to another exemplary embodiment, the interior fabric composite further includes at least one layer of adhesive film (scrim, resin, or other bonding agent) between adjacent ballistic layers.

According to another exemplary embodiment, the interior fabric composite further includes top and bottom composite covers, and at least one layer of adhesive film (scrim, resin, or other bonding agent) between respective outside ballistic layers and the top and bottom composite covers.

According to another exemplary embodiment, the retention assembly includes an interconnected arrangement of elongated straps located between the top assembly cover and the interior ballistic fabric composite.

According to another exemplary embodiment, the straps comprise nylon webbing.

According to another exemplary embodiment, an elongated generally C-shaped step cover is attached at a peripheral edge of the floor blanket.

According to another exemplary embodiment, the top and bottom assembly covers have complementary peripheral fasteners (e.g., snap fasteners) adapted for releasably holding the floor blanket together.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
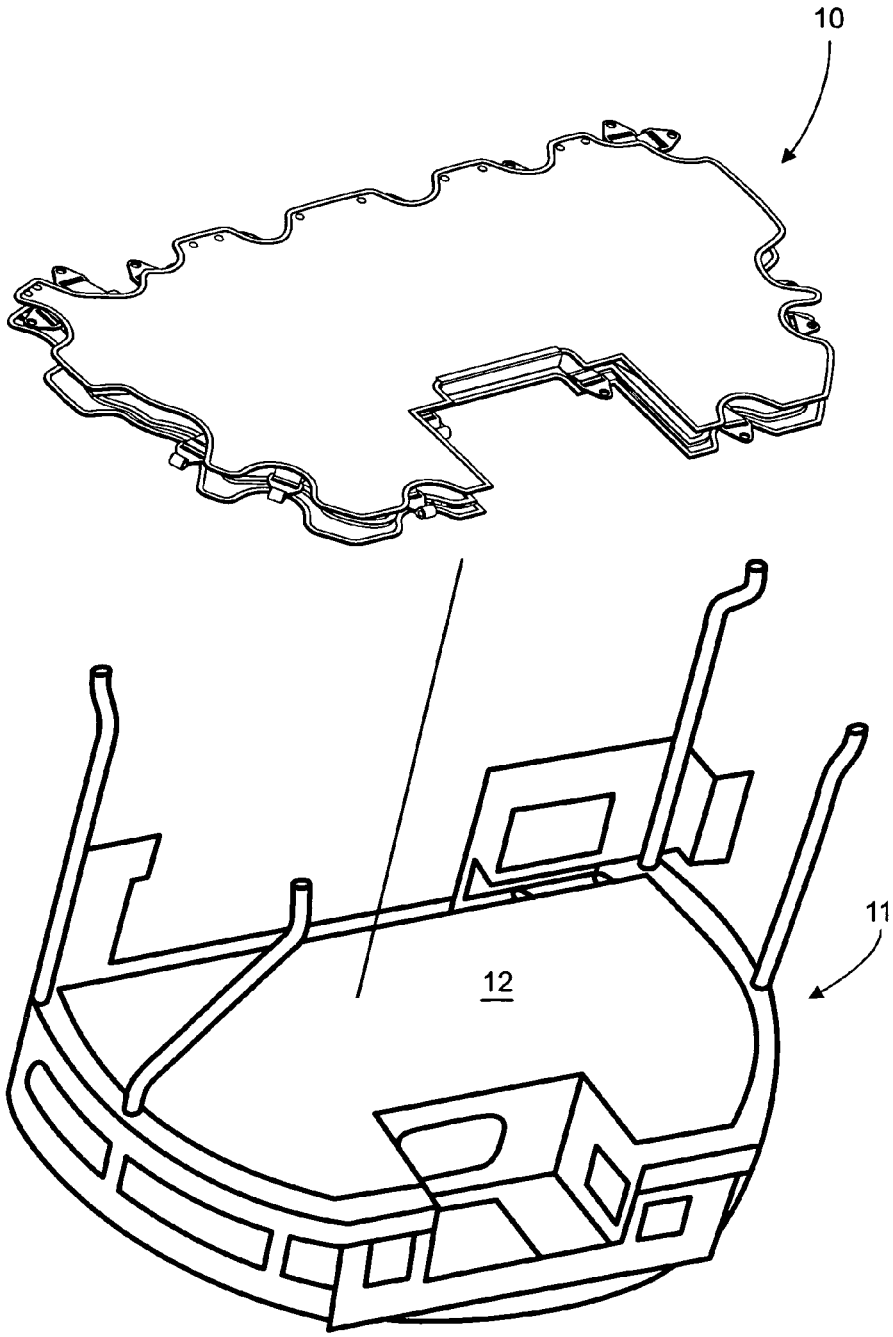
FIG. 1 is a perspective view illustrating placement of the present exemplary ballistic floor blanket in a conventional gun turret of a miliary vehicle.
Figure 2:
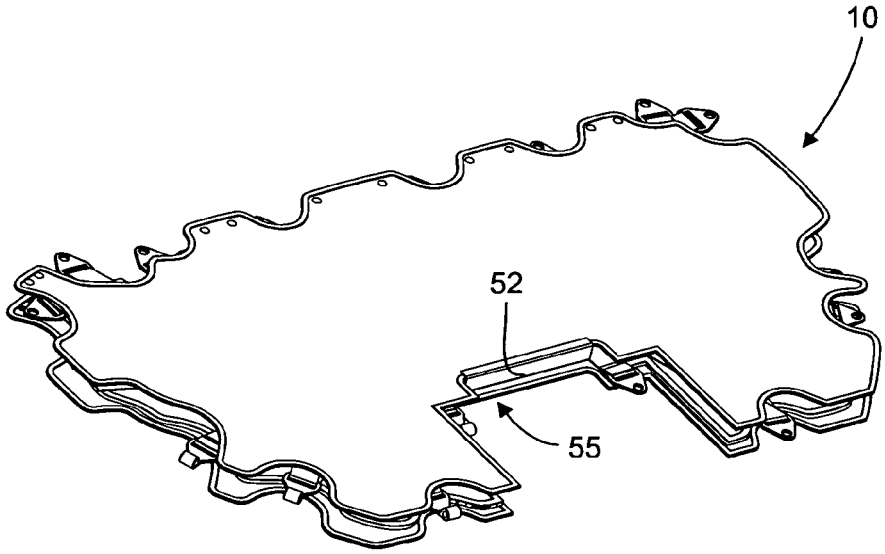
FIG. 2 is a further perspective view of the exemplary ballistic blanket.

Referring now specifically to the drawings, a ballistic floor blanket according to one exemplary embodiment of the present invention is illustrated in FIGS. 1 and 2, and shown generally at reference numeral 10. In the exemplary application shown, the present ballistic blanket 10 may be used in a weapons turret 11 of a military vehicle (e.g., Bradley Fighting Vehicle, such as the M2 or M3). The ballistic blanket 10 covers a multi-panel floor 12 of the weapons turret 11, and functions to shield and protect vehicle occupants against blast fragments and secondary projectiles resulting from improvised explosive devices (IEDs), mine blasts, and other under-vehicle explosions. The ballistic blanket 10 may be flexible, rigid, or semi-rigid; or flexible in parts and rigid or semi-rigid in other parts.

Figure 3:
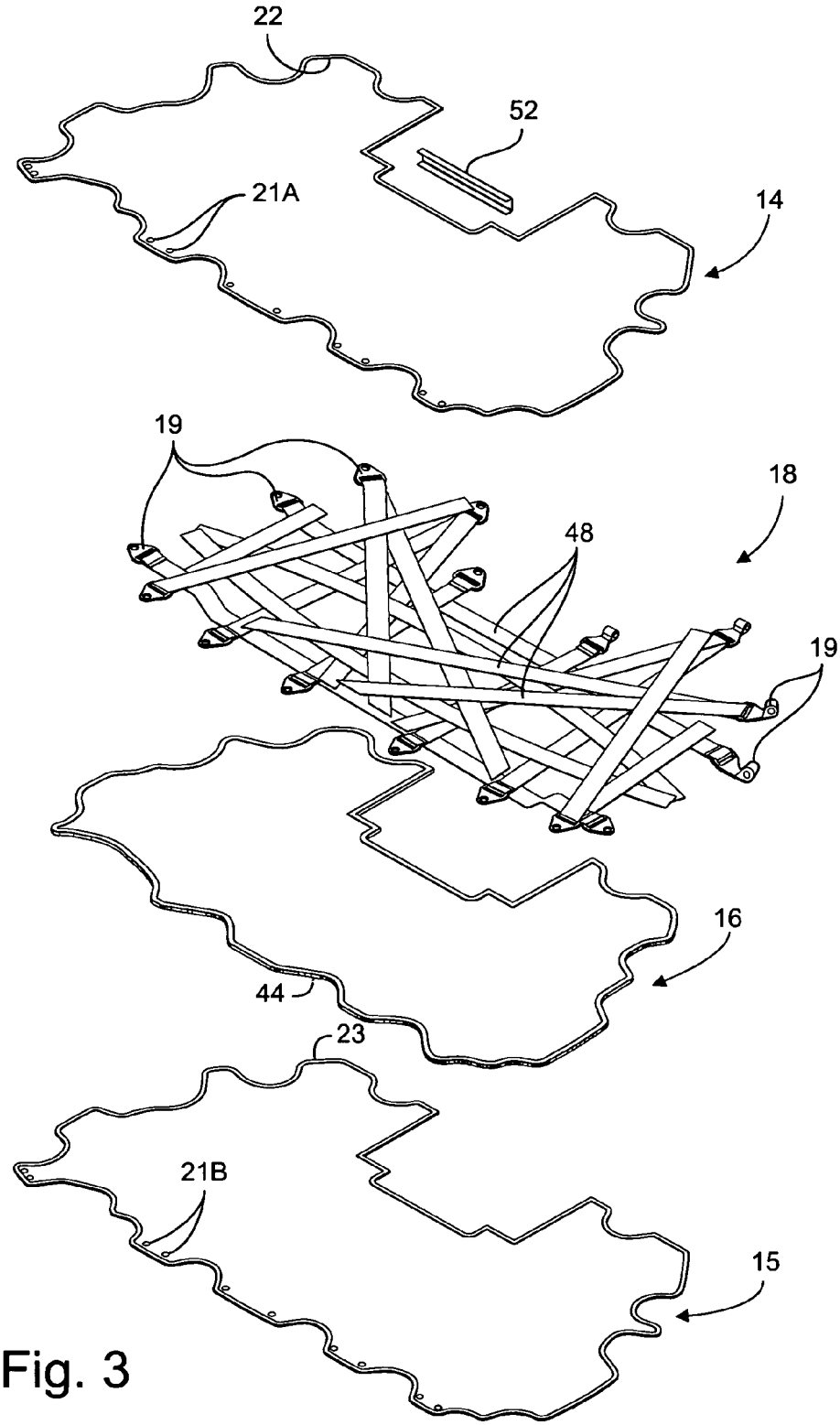
FIG. 3 is a perspective view of the ballistic blanket with its various components pulled apart for clarity.

As best shown in FIG. 3, the present ballistic blanket 10 comprises top and bottom assembly covers 14 and 15, an interior ballistic fabric composite 16 intermediate the top and bottom covers 14, 15, and a retention assembly 18 comprising a number of peripherally spaced floor anchors 19. The floor anchors 19 may comprise steel bolt-in and quick release end fittings, or other mechanical or adhesive attachment means. The exemplary anchors 19 cooperate with suitable hardware (not shown) to secure the ballistic blanket 10 to the floor 12 of the turret 11.

The top and bottom assembly covers 14, 15 include complementary peripheral fasteners 21A, 21B, such as snap fasteners, designed to releasably attach the covers 14, 15 together outside of the ballistic fabric composite 16 and retention assembly 18. Other suitable cover fasteners may include hook and hoop patches, mechanical clips, pressure-sensitive adhesives, and the like. The exemplary top cover 14 resides loosely adjacent (unattached to) the retention assembly 18, and is constructed of flame-resistant nylon filament reinforced neoprene rubber. The exposed top surface of the cover 14 may be textured for added slip resistance. The exemplary bottom cover 15 resides loosely adjacent the ballistic fabric composite 16, and is constructed of a urethane coated polyester ripstop. Additionally, both covers 14, 15 may include edge binding tape 22, 23 engineered to meet or exceed physical requirements, such as MIL-PRF-5038J Type II, for military usage.

Figure 4:
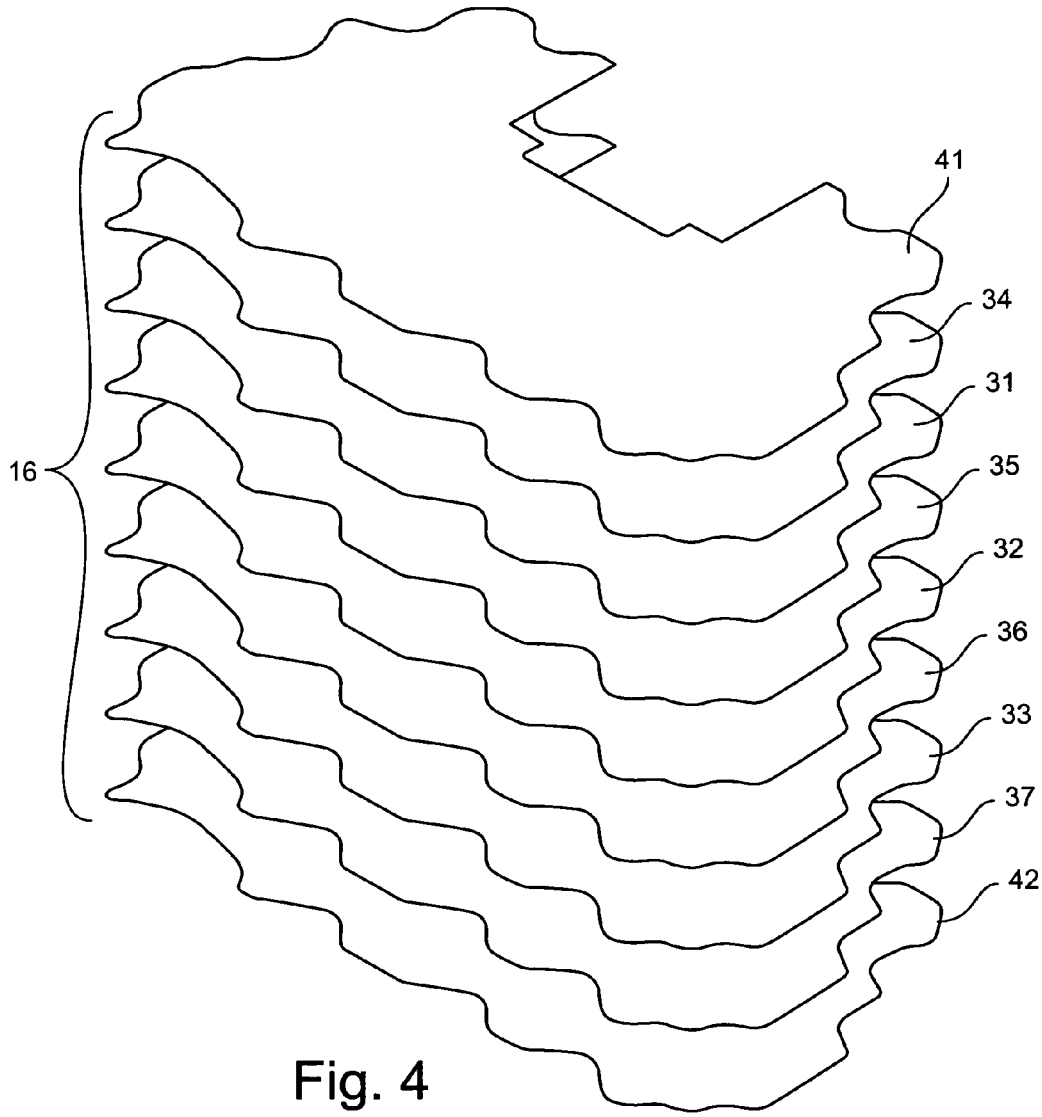
FIG. 4 is a perspective view of the ballistic fabric composite with its various layers pulled apart for clarity.

Referring to FIGS. 3 and 4, the exemplary ballistic fabric composite 16 comprises a multiple layer arrangement of overlying (or superimposed) ballistic plies 31, 32, 33, and adhesive film 34, 35, 36, 37 sandwiched between opposing top and bottom composite covers 41, 42. The top and bottom covers 41, 42 may be constructed of a flame-resistant synthetic rubber, such as chlorosulfonated polyethylene synthetic rubber (CSM). One commercial example of a suitable CSM is that produced by DuPont Performance Elastomers under the trademark Hypalon®.

In the exemplary embodiment, the ballistic fabric composite 16 comprises three intermediate structural ballistic layers 31, 32, 33 interleaved with thermoplastic film layers 35, 36. The film layers 34, 37 reside between the top and bottom composite covers 41, 42 and respective outside ballistic layers 31, 33. The film layers 34-37 may comprise polyurethane film, scrim, or other suitable polymer adhesives. The ballistic layers 31-33 are constructed of bundled high performance continuous fibers, and may be single ply or multi-ply laminate structures. Examples of high performance fibers include S-glass composed of silica ($SiO_2$), alumina ($Al_2O_3$), and magnesia (MgO); aramid fibers, such as commercially-known Twaron®, Technora®, and DuPont's Kevlar®29, Kevlar®49, Kevlar® 129, and Kelvar® KM2; high molecular weight polyethylene (HMWPE), such as commercially-known Spectra® and Dyneema®; polybenzobisoxazole (PBO) fibers, such as commercially-known Zylon®; and polypyridobisimidazole (PIPD), such as commercially-known M5®. These fibers have high tensile strength, elastic modulus, and strain to failure. For example, such fibers may have a tensile strength greater than about 2000 MPa and an elastic modulus greater than about 60 GPa. Fibers structures in the exemplary application may be unidirectional, plain, or basketweave configurations. The unidirectional fiber layers may be rotated 90° (or other angle) with respect to adjacent layers to create a cross-ply fabric.

Once assembled, as discussed above, the fabric composite 16 is laminated under heat and pressure to create an integrally-formed unitary ballistic structure. Alternatively, two or more of the composite layers may be stitched together, or joined together using thermosetting polymers. A binding tape 44 may be applied to the fabric composite 16 to finish the peripheral edge.

Figure 5:
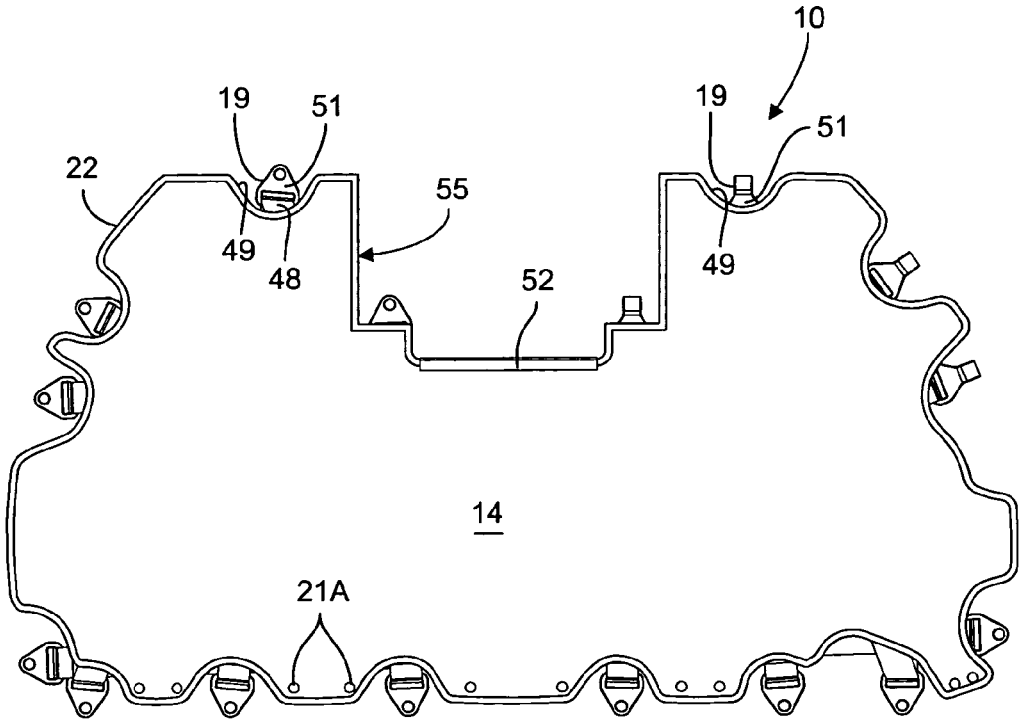
FIG. 5 is a top view of the ballistic blanket laid flat.

As best shown in FIGS. 3 and 5, the exemplary retention assembly 18 resides loosely (unattached) between the top assembly cover 14 and the ballistic fabric composite 16, and comprises an interconnected and intersecting arrangement of high-strength straps 48. The exemplary straps 48 may comprise 1-2" nylon webbing with a tensile strength of 4,500 lbf or more. Respective free ends of the straps 48 are preferably attached to the body of adjacent straps, such as by sewing or welding. The floor anchors 19 of the retention assembly 18 are carried by the straps 48, and project beyond the periphery of the ballistic blanket 10 at concaved (or radiused) edges 49. Each anchor 19 may comprise a steel web shield 51 which occupies a substantial portion of the open space defined by the concaved edge 49.

The exemplary ballistic blanket 10 may be assembled in the turret 11 by laying the bottom assembly cover 15 over the turret floor 12, then laying the ballistic fabric composite 16 over the bottom cover 15, then applying and attaching the retention assembly 18 to the turret 11 (using bolts and other hardware not shown), then laying the top assembly cover 14 over the retention assembly 18 and fastening the top and bottom covers 14, 15 together using the mating snap fasteners 21A, 21B. Alternatively, the various components of the ballistic blanket 10 may be preassembled prior to attaching the retention assembly 18 to the turret floor 12. Additionally, as best shown in FIGS. 2, 3, and 5, an elongated generally C-shaped rigid step cover 52 may be located in an step cut-out 55 of the ballistic blanket 10, and secured along a peripheral edge of at least the top assembly cover 14.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A ballistic floor blanket for use in a military vehicle, said floor blanket comprising:

top and bottom assembly covers;

an interior ballistic fabric composite intermediate said top and bottom assembly covers and comprising a plurality of overlying structural ballistic layers, said ballistic layers comprising high-performance fibers having a tensile strength greater than about 2000 MPa and an elastic modulus greater than about 60 GPa; and a retention assembly comprising a plurality of peripherally spaced floor anchors adapted for attaching said floor blanket to the military vehicle, and an interconnected arrangement of elongated straps located between said top assembly cover and said ballistic fabric composite.

2. A ballistic floor blanket according to claim 1, wherein said high performance fibers are selected from a group consisting of S-glass, aramid, high molecular weight polyethylene (HMWPE), polybenzobisoxazole (PBO), and polypyridobisimidazole (PIPD).

3. A ballistic floor blanket according to claim 1, wherein said ballistic fabric composite comprises an adhesive film residing between adjacent ones of said ballistic layers.

4. A ballistic floor blanket according to claim 1, wherein said top assembly cover comprises a textured slip-resistant material.

5. A ballistic floor blanket according to claim 4, wherein said slip-resistant material comprises neoprene rubber.

6. A ballistic floor blanket according to claim 1, wherein said bottom assembly cover comprises a ripstop fabric.

7. A ballistic floor blanket according to claim 6, wherein said ripstop fabric comprises a urethane coated polyester ripstop.

8. A ballistic floor blanket according to claim 1, wherein said ballistic fabric composite further comprises top and bottom composite covers.

9. A ballistic floor blanket according to claim 8, wherein said top and bottom composite covers comprise a flame resistant synthetic rubber.

10. A ballistic floor blanket according to claim 9, wherein said synthetic rubber comprises a chlorosulfonated polyethylene synthetic rubber (CSM).

11. A ballistic floor blanket according to claim 1, wherein said ballistic fabric composite comprises at least three overlying ballistic layers.

12. A ballistic floor blanket according to claim 11, wherein said ballistic fabric composite further comprises at least one layer of adhesive film between adjacent ballistic layers.

13. A ballistic floor blanket according to claim 12, wherein said ballistic fabric composite further comprises top and bottom composite covers, and at least one layer of adhesive film between respective outside ballistic layers and said top and bottom composite covers.

14. A ballistic floor blanket according to claim 1, wherein said straps comprise nylon webbing.

15. A ballistic floor blanket according to claim 1, and comprising an elongated generally C-shaped step cover attached at a peripheral edge of said floor blanket.

16. A ballistic floor blanket according to claim 1, wherein said top and bottom assembly covers comprise complementary peripheral fasteners adapted for releasably holding said floor blanket together.

17. A ballistic floor blanket for use in a military vehicle, said floor blanket comprising:

top and bottom assembly covers;

an interior ballistic fabric composite intermediate said top and bottom assembly covers and comprising a plurality of overlying structural ballistic layers; and a retention assembly located between said top assembly cover and said ballistic fabric composite, said retention assembly comprising an interconnected arrangement of elongated straps and a plurality of peripherally spaced floor anchors adapted for attaching said floor blanket to the military vehicle.

18. A ballistic floor blanket according to claim 17, wherein said top assembly cover comprises a textured slip-resistant material.

19. A ballistic floor blanket according to claim 17, wherein said ballistic fabric composite further comprises top and bottom composite covers located outside of said overlying ballistic layers, and constructed of a flame resistant synthetic rubber.

20. A ballistic floor blanket for use in a military vehicle, said floor blanket comprising:

top and bottom assembly covers;

an interior ballistic fabric composite intermediate said top and bottom assembly covers and comprising a plurality of overlying structural ballistic layers, said ballistic layers comprising high-performance fibers having a tensile strength greater than about 2000 MPa and an elastic modulus greater than about 60 GPa; and a retention assembly comprising a plurality of peripherally spaced floor anchors adapted for attaching said floor blanket to the military vehicle, and an interconnected arrangement of intersecting elongated straps located between said top assembly cover and said ballistic fabric composite.

* * * * *